US008167255B2

(12) United States Patent
Tzuo

(10) Patent No.: US 8,167,255 B2
(45) Date of Patent: May 1, 2012

(54) HINGE WITH ELASTIC ELEMENT AND TAB ADAPTED IN CARDBOARD DISPLAY STANDS FOR ASSEMBLY, FLATTENING AND AUTOMATIC SET-UP SYSTEMS

(76) Inventor: Chung Kwo Tzuo, Sao Paulo (BR)

( * ) Notice: Subject to any disclaimer, the term of this patent is extended or adjusted under 35 U.S.C. 154(b) by 124 days.

(21) Appl. No.: 12/524,526

(22) PCT Filed: Mar. 6, 2009

(86) PCT No.: PCT/IB2009/050949

§ 371 (c)(1),
(2), (4) Date: Dec. 3, 2009

(87) PCT Pub. No.: WO2009/147542

PCT Pub. Date: Dec. 10, 2009

(65) Prior Publication Data

US 2010/0072330 A1 Mar. 25, 2010

(51) Int. Cl.
*A45D 19/04* (2006.01)

(52) U.S. Cl. ..... 248/174; 211/149

(58) Field of Classification Search ..... 248/174, 248/152, 459; 211/72, 73, 135, 149
See application file for complete search history.

(56) References Cited

U.S. PATENT DOCUMENTS

| | | | | |
|---|---|---|---|---|
| 2,312,644 | A * | 3/1943 | Horr | 40/787 |
| 3,021,042 | A * | 2/1962 | Stumpf, Jr. | 229/5.5 |
| 4,570,805 | A * | 2/1986 | Smith | 211/149 |
| RE32,668 | E * | 5/1988 | Smith | 211/149 |
| 5,632,390 | A * | 5/1997 | Podergois | 211/195 |
| 5,711,438 | A * | 1/1998 | Smith | 211/149 |
| 6,347,772 | B1 * | 2/2002 | L'Hotel | 248/174 |
| 6,488,245 | B1 * | 12/2002 | Maglione | 248/174 |
| 7,070,057 | B2 * | 7/2006 | Moss et al. | 211/132.1 |
| 2007/0235396 | A1 * | 10/2007 | Moss et al. | 211/72 |

* cited by examiner

*Primary Examiner* — Anita M King
(74) *Attorney, Agent, or Firm* — Husch Blackwell LLP

(57) ABSTRACT

"HINGE WITH ELASTIC ELEMENT AND TAB ADAPTED IN CARDBOARD DISPLAY STANDS FOR ASSEMBLY, FLATTENING AND AUTOMATIC SET-UP SYSTEMS", formed from a cardboard plate (1) with creases (2), (3) and (4) which mark the swinging segments (6), (7), (8), (9) and (10), forming a hinge (14) to be applied to display stands (such as display shelf, display-box, totem and other similar objects obtained from the central cardboard cutting and creasing design), operating through tension imposed by the elastic loop (15) anchored into the cuts (17) of a beveled tab (16) internal or posterior, positioned in the junction points of the adjacent walls (P) of the display stand (D). The hinge (14) works in clamping system, closing itself strongly tensioned during the display stand (D) flattening, for piling, transportation and delivery to the client, secured in an envelope. After delivery, the hinge (14) is opened by pulling offered by the loop (15), pushing forcefully the flattened walls (P) of the display stand (D), for its automatic opening and set-up.

6 Claims, 6 Drawing Sheets

Figures 1, 2:
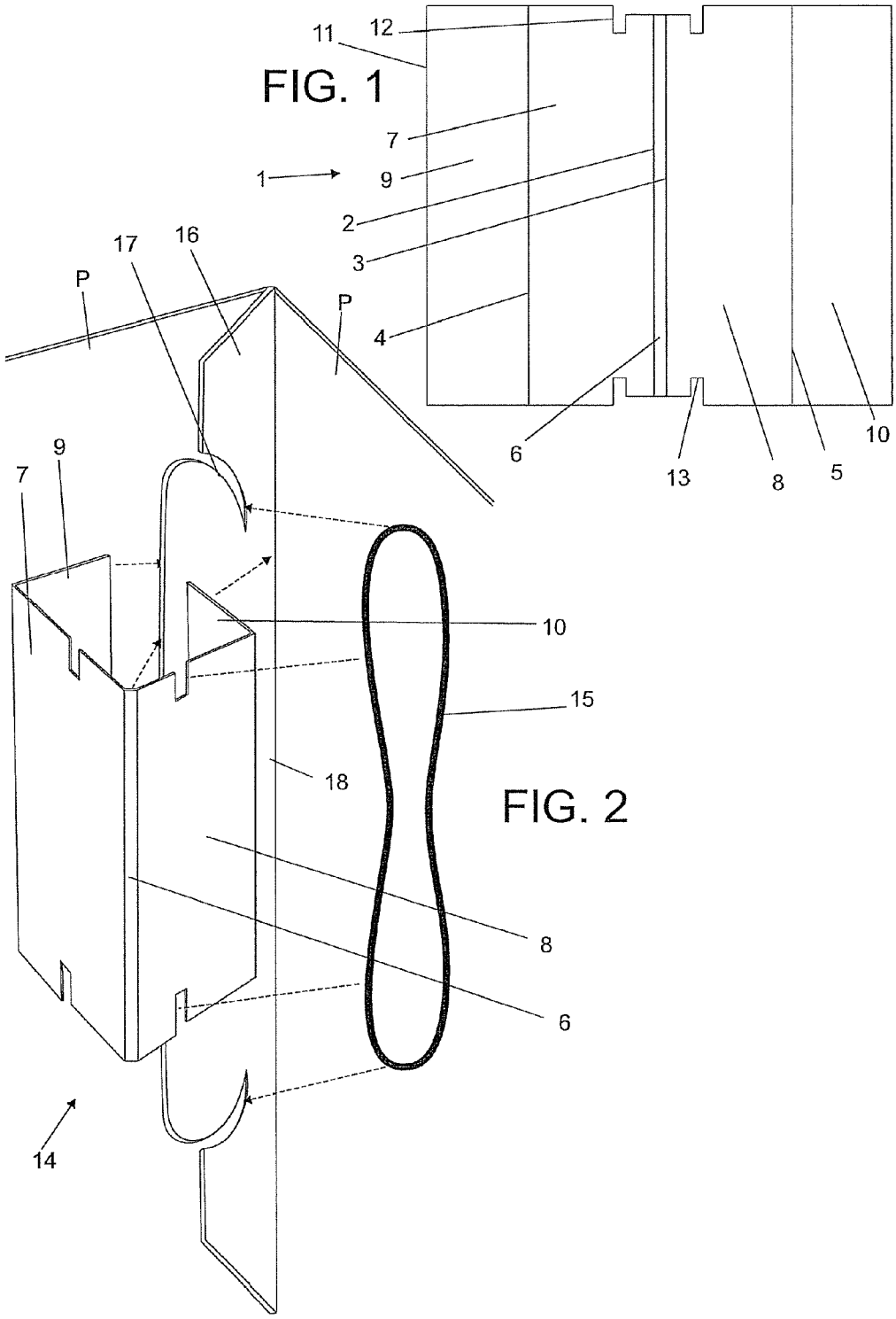

12
10
8
13
16
9
7
6
14
17
15
18

HINGE WITH ELASTIC ELEMENT AND TAB ADAPTED IN CARDBOARD DISPLAY STANDS FOR ASSEMBLY, FLATTENING AND AUTOMATIC SET-UP SYSTEMS

FIELD OF THE INVENTION

The present description report refers to a invention patent request of a hinge designed from a cardboard plate, which is cut and creased upon reception of five joint segments, besides central indentation-guide briefly extended from its upper and lower edges, created for the passage of an elastic loop. The loop in its turn is anchored between two cuts previously made in the internal or posterior tab of cardboard parts obtained also through cutting and creasing design, such as several display stands, totems, and shelves.

The tab is arranged so as to be positioned in a beveled manner between two adjacent walls of the display stand and receives said hinge, secured in several units by its elastic loops, internally embedded or invisible (afterwards). A closure and open swinging set in clamping system for the display stand is formed by the hinge action, allowing the system to be flattened and folded and that, after delivery to the interested party, when required, it is automatically "set-up".

DESCRIPTION OF RELATED ART

Nowadays there are self-bearing display stands, that is, which may be flattened and folded to be piled and transported and, after delivery to the user, when unfolded, are instantaneously and automatically set-up. Such cardboard parts receive cutting and creasing designs more and more sophisticated, resulting in display shelves, display-boxes, totems and several other structures in varied formats.

A swinging system for display automatic opening is known, for example, the PI 0604189-2, applied on Jul. 7, 2006, with the title "PART/SPRING INTRODUCED IN DISPLAY STAND, FOR AUTOMATIC OPENING SYSTEM", which claims for a system of internal spring so that there is automatic opening of ellipsoid and semi-ellipsoid cardboard display stands, through an ellipsoid or semi-ellipsoid part/spring in the shape of metallic or plastic thin belt or wire, whose molecules are guided during laminating (metal) or extrusion (plastic), to acquire elastic memory, forming, therefore, a laminar part/spring or in the shape of wire, gauged according to the sizes of display to which it is installed.

Said part/spring must be assembled flat, that is, with its two ends pressed against the internal walls between the side edges of the display overlaying faces, which may, after being flattened, be folded and piled, being that after unfolding the part/spring returns to its initial format, expanding and causing the system to open automatically.

Another patent request, PI 0801165, applied on with the title "ARRANGEMENT OF ELASTIC STRIPS BY ANCHORAGE POINT SYSTEM IN CARDBOARD SHEET FOR DISPLAY-BOX AUTOMATIC ASSEMBLY AND ACTIVATION", proposes that from the cutting and creasing design, a cardboard sheet receives anchorage spots in the extension related to the bottom of the box to be formed, spots distributed so as to allow the fixation, passage and surrounding of said extension by means of elastic stripes.

After surrounding the extension related to the bottom of the future display-box, the stripes form an elastic circuit of uniform tensioning, associated to gaps surveyed between fits of cuts and keys, so as to offset, with light displacement, the overlaying of external portions on said bottom. The box is stored, transported, and delivered flattened, packed into an envelope or between two cardboard plates for instance and, upon arrival at the client, after envelope unpackaging, it is immediately set-up automatically by means of cutting and creasing design associated to the elastic stripe circuit.

Nowadays there are other systems composed of elastic stripes, which, upon being flattened after display automatic activation, do not remain embedded and require coverage by another additional component produced or not during the cardboard cutting and creasing design. This action raises the display final cost besides making the cutting and creasing design more complex.

SUMMARY OF THE INVENTION

The hinge in question, reason of such patent request, is comprised of a cardboard plate and owns a central double crease, complemented by two other vertical side creases duly distanced, designed from the upper edge to the lower opposed edge, forming thus five swinging segments among themselves in said cardboard plate, being one central segment and two intermediate segments adjacent to their peripheral respective segments.

The two intermediate segments receive each a pair of small indentation-guides, performed from the upper edge, aligned to another pair of indentation-guides, in its turn performed from the cardboard plate lower edge, while the intermediate segments own free sides or touching sides.

Thus composed, the cardboard plate shall work as a hinge for automatic opening of modules like display stands, display shelves, display-boxes, totems and other similar objects obtained from cardboard cutting and creasing design.

The hinge is complemented by an elastic continuous strip in the shape of a loop, passing through the pairs of indentation-guides of the upper and lower edges of the intermediate segments, being that the operation system projects further, in the cutting and creasing design, composition of internal or posterior tabs, positioned in a beveled way in the joining spots of the display adjacent walls.

Each beveled tab receives a series of cuts, performed in pairs, distanced so as to form extensions for the hinge back, which shall be inserted so as to hold said beveled internal tab by means of sides of the back of its peripheral segments.

After positioned, the hinge anchors, therefore, its backing sides along the beveled internal tab junction with the adjacent walls, as well as touches its central segment to the free edge of the same internal tab. Thus, the hinge is totally stabilized next to the beveled tab and the adjacent walls in a position to operate in "clamping system".

The hinge fixation is by means of an elastic loop, passing through its own indentation-guides and inserted into the upper and lower cuts of the beveled internal tab.

This way, the display stand walls may be stretched together with the hinge, whose segments swing by means of creases, following the stretching out, tensioning strongly the elastic loop, anchored on the cuts of the beveled tab. The stretched display may be folded and thus kept, surrounded by an envelope or secured by two cardboard plates.

To be used simultaneously to the removal from the envelope, the central and peripheral segments of the hinge are strongly pulled by the elastic loop anchored on the beveled tab, returning to its initial shape, "swinging in a clamping system" by the action of creases, pushing forcefully the display flattened walls. Then, the automatic opening and activation are caused. The display stand of such automatic opening system—by means of hinges, may be a display shelf, display-box as per the cutting and creasing design or another cardboard similar displaying device.

CONCISE DESCRIPTION OF THE DRAWINGS

Figures 3, 4, 5:
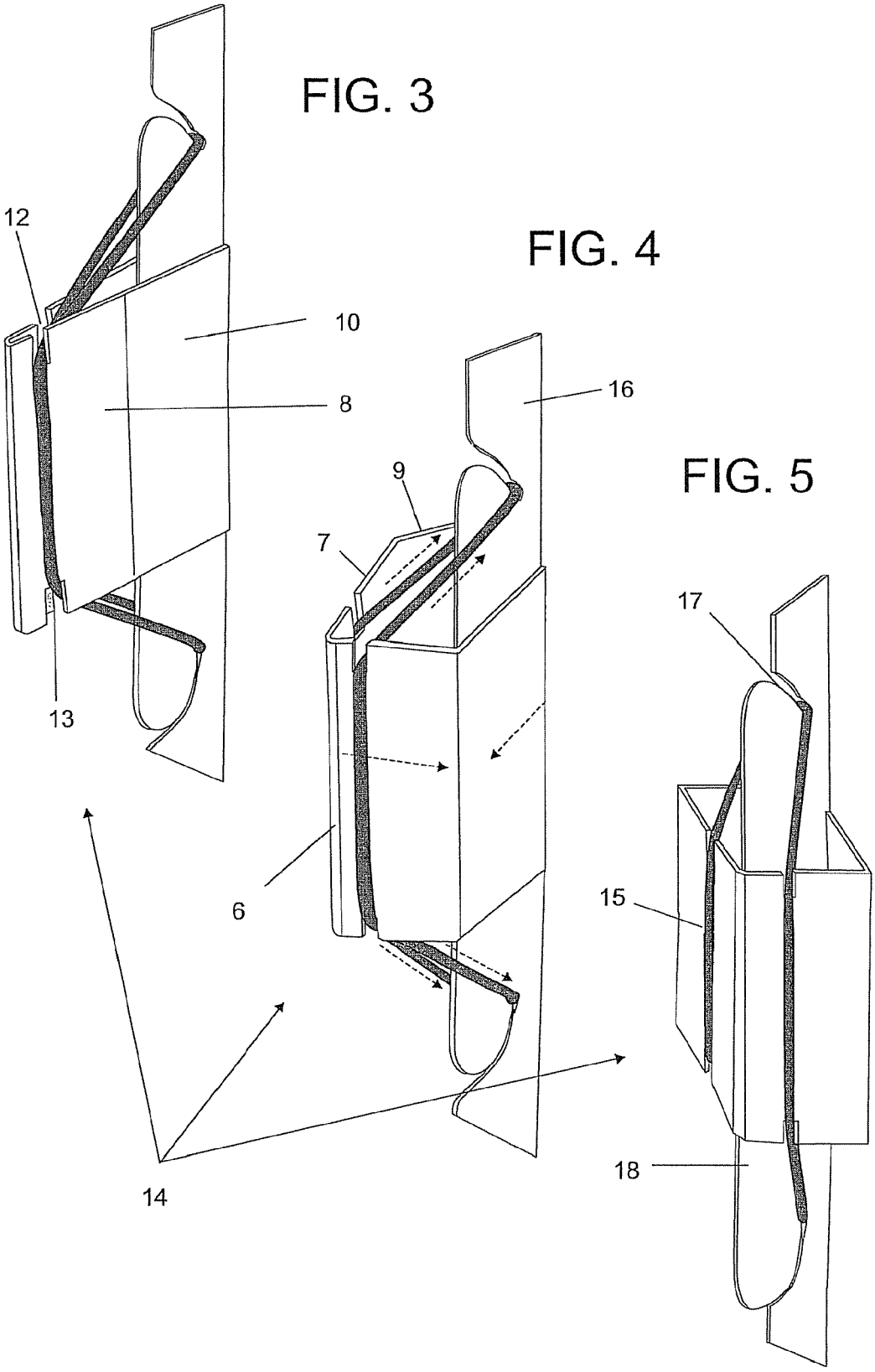

Explained superficially, the hinge, flattening and automatic opening systems are better described in the drawings attached:

FIG. 1—Plan view of the cardboard plate open, showing the creases forming the hinge swinging segments, as well as the indentation-guides performed from the upper and lower edges of the intermediate segments;

FIG. 2—Cross-section view, showing the hinge positioning direction towards the beveled internal tab and the display adjacent walls. As noted by the hatched arrows, the hinge surrounds respectively the free edge and the extension corresponding to the beveled tab, through the central segment and the back sides of the peripheral segments, anchoring next to the display adjacent walls. The elastic loop passage through the indentation-guides of the intermediate segments as well as its insertion into the cuts of the beveled internal tab, are also shown by hatched lines;

FIG. 3—Cross-section view, showing the hinge closed, that is flattened, following the flattening of the display adjacent walls;

FIG. 4—View as the prior figure, showing the hinge being opened, with its segments swinging in clamping system, carrying the display adjacent walls, starting it automatic opening;

FIG. 5—View as the prior figure, showing the hinge already opened, after swinging of its segments, when the adjacent walls were pushed, obtaining the display automatic opening.

Figure 6:
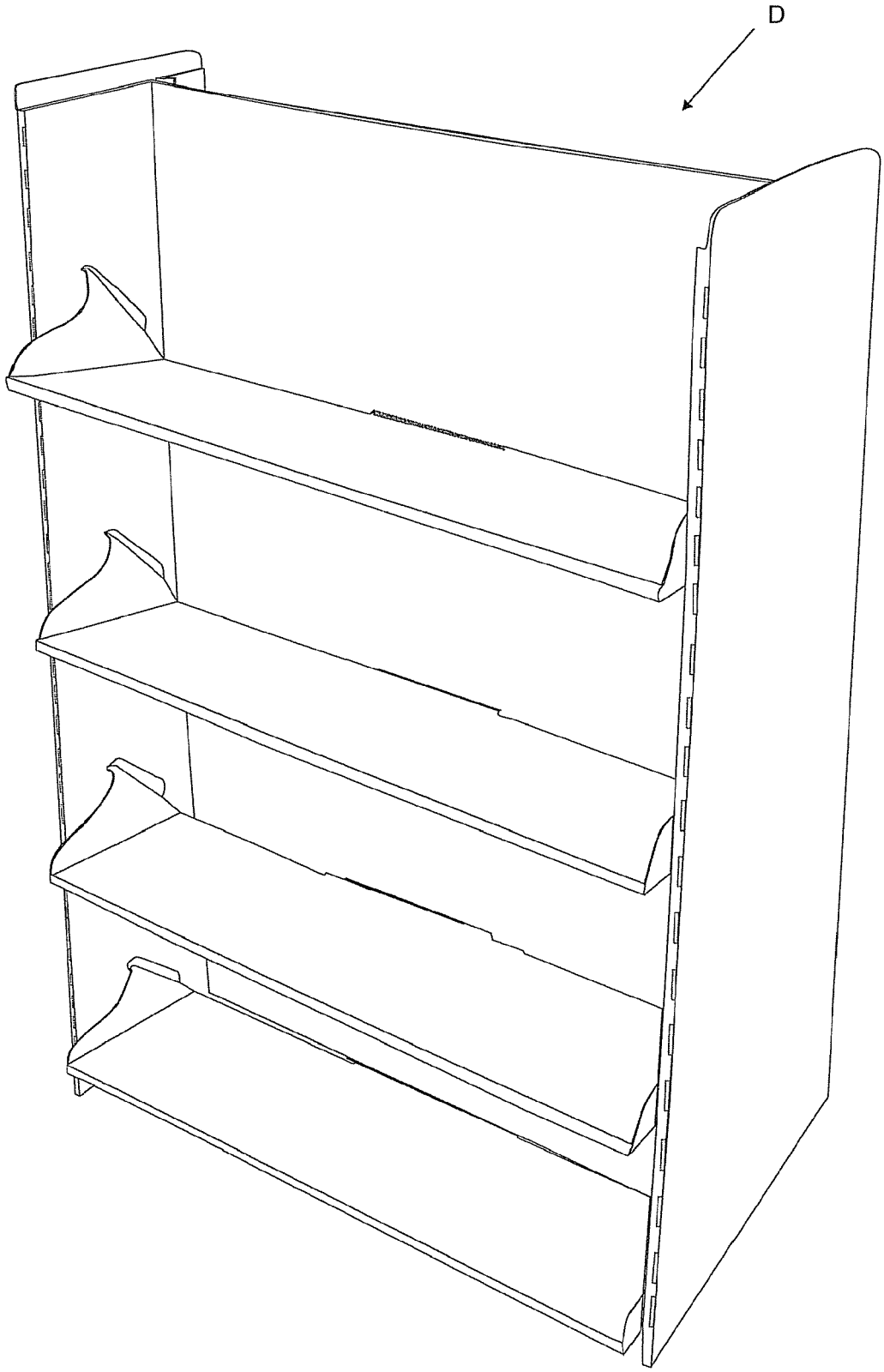
Figure 7B:
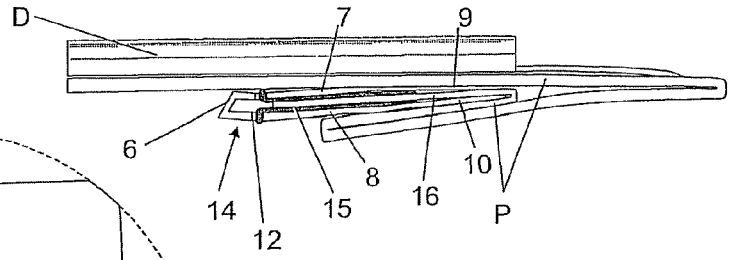
Figure 7C:
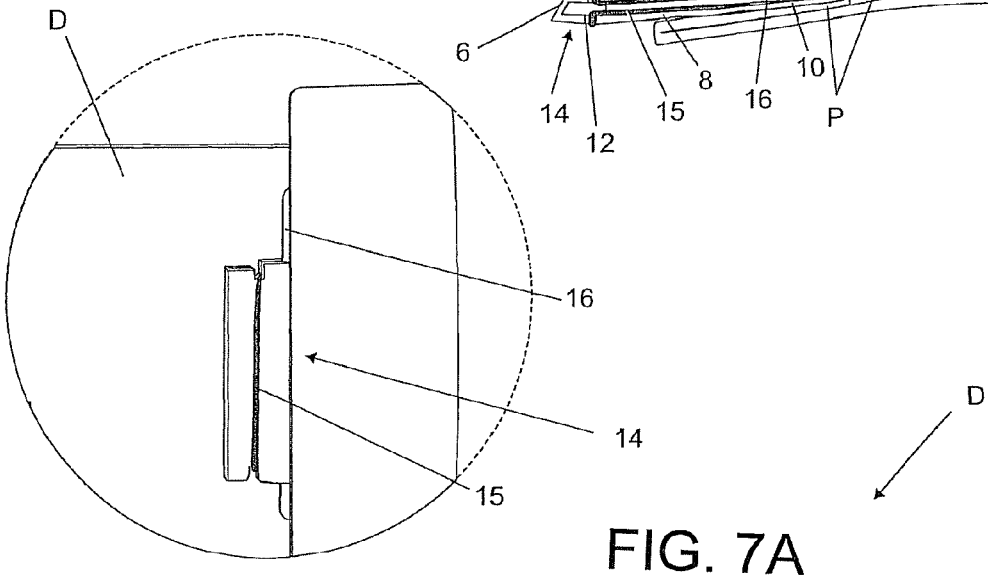
Figure 7A:
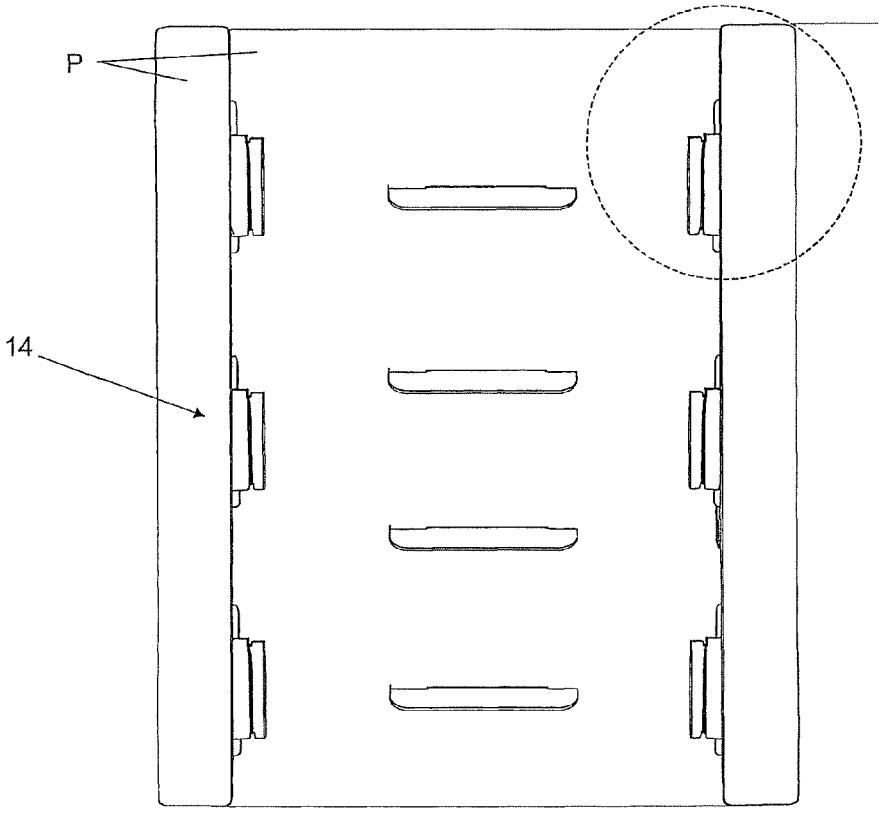
Figure 8B:
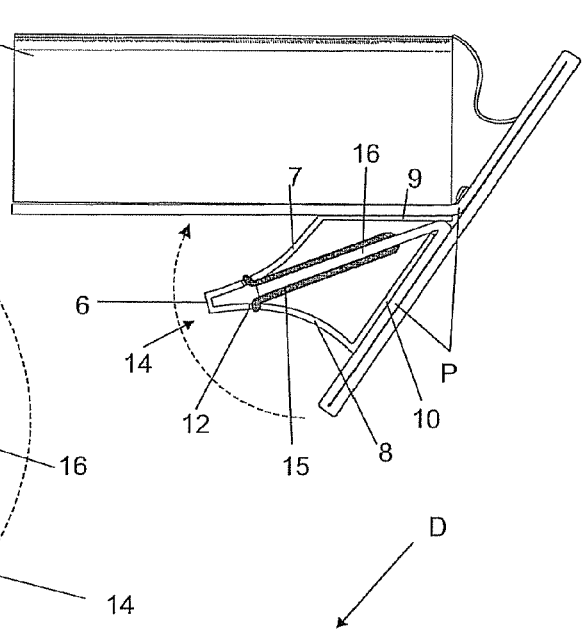
Figure 8C:
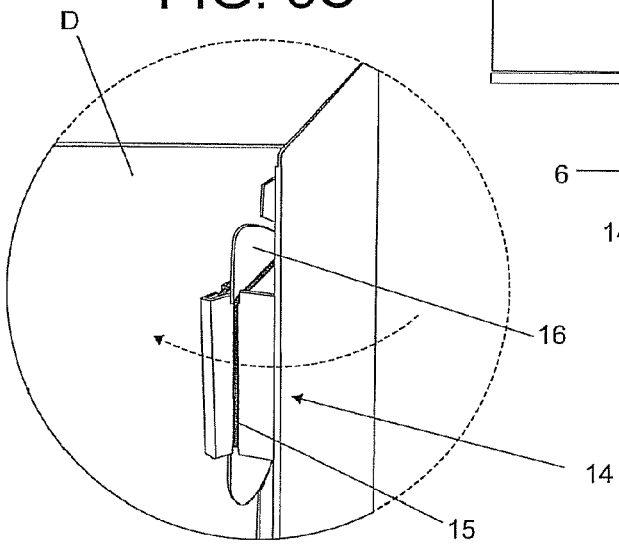
Figure 8A:
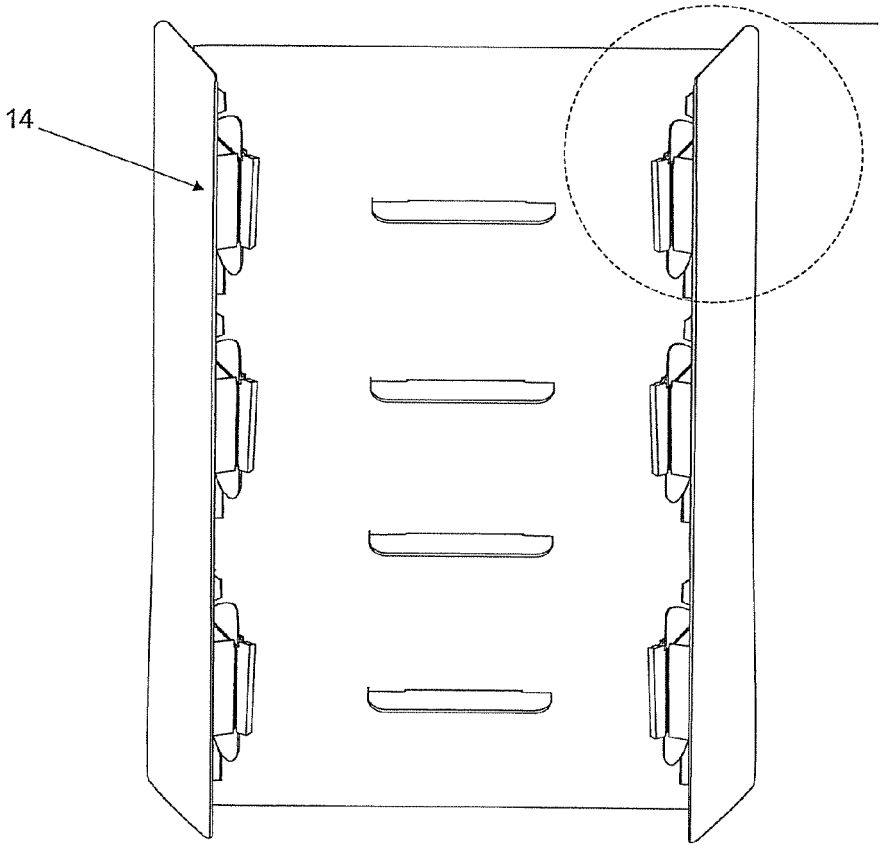
Figure 9B:
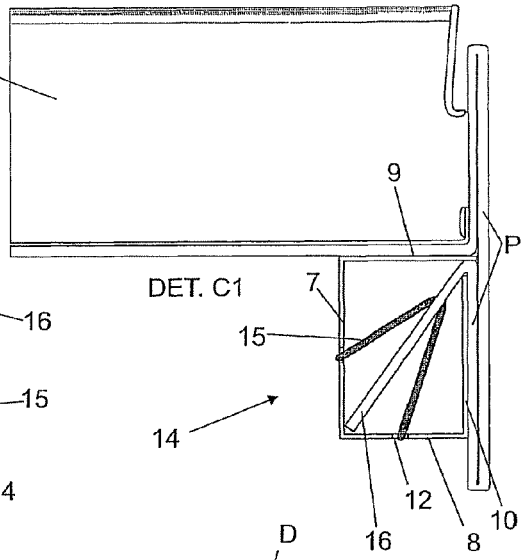
Figure 9C:
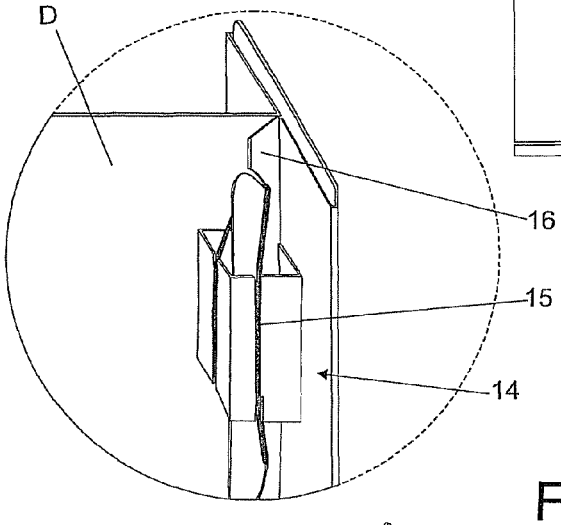
Figure 9A:
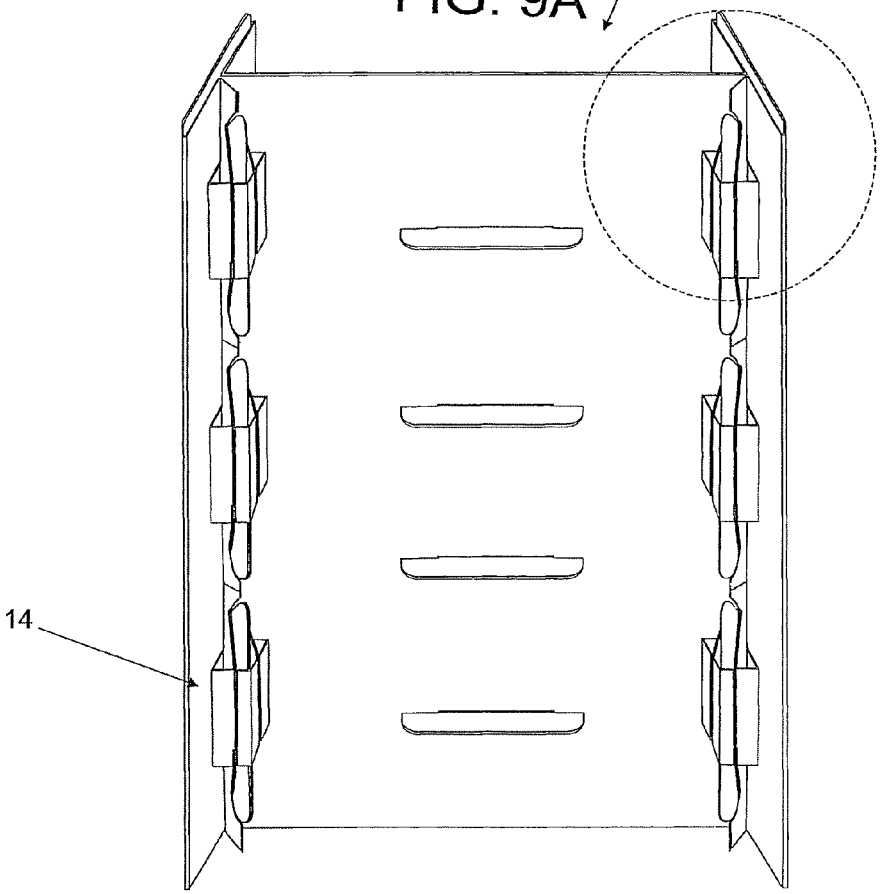

The figures listed below portray the performance of a hinge applied to a cardboard display stand, in such case, as example, being shown a 4-board shelf, obtained by cutting and creasing design. The hinge may be applied to any cardboard display stand for the automatic activation system:

FIG. 6—Front cross-section view of a display stand, in such case a cardboard shelf with boards, with cutting and creasing design, associated to the use of hinges for automatic flattening and opening;

FIGS. 7A-C—Display stand posterior view, showing the hinges duly sheltered by the elastic loops between the cuts of beveled internal tabs for the automatic opening system. When the display stand is closed, as shown by Figure C, the swinging flattened segments together with the display stand adjacent walls are strongly tensioned by the elastic loop, sharply stretched from the beveled tab cuts. Next to it, FIG. 7B, showing the hinge, in the same condition, in upper plan;

FIGS. 8A-C—View as prior figure, showing the hinges semi-open. In such condition, its segments are being strongly pulled by the elastic loop, being folded and pushing the display stand adjacent walls for its opening. Above, FIG. 8C, showing an enlarged hinge and, next to it, FIG. 8B, showing a hinge, in the same condition, in upper plan;

FIGS. 9A-C—View as prior figure, showing the hinges opened by its swinging segments, after the pull-out by the elastic, pushing the adjacent walls to the display stand automatic opening. Above, FIG. 9C, showing an enlarged hinge and, next to it, FIG. 9B, showing the hinge in the same condition, in upper plan.

DETAILED DESCRIPTION OF AN EMBODIMENT OF THE INVENTION

In compliance with the drawings attached, the "HINGE WITH ELASTIC ELEMENT AND TAB ADAPTED IN CARDBOARD DISPLAY STANDS FOR ASSEMBLY, FLATTENING AND AUTOMATIC SET-UP SYSTEMS", object of the present invention patent request is made up by a cardboard plate (1) passed through cutting and creasing design, when it obtains format preferably rectangular, suffering simultaneously central creases (2) and (3) briefly distanced among themselves, followed in a larger distancing by two other side creases (4) and (5). The creases (2), (3), (4) and (5) are vertical, projected from the upper edge to the lower edge opposed of the cardboard plate (1), forming thus five segments swinging among themselves, that is, a central segment (6) of reduced width, adjacent to two intermediate segments (7) and (8), each adjacent to its respective peripheral segment (9) and (10), which in its turn own free backing sides (11).

The two intermediate segments (7) and (8) receive each a pair of small indentation-guides (12), performed from the upper edge, aligned to another pair of indentation-guides (13), in its turn performed from the lower edge of the plate, forming thus the hinge itself (14).

Thus composed, the hinge (14) shall be used in a system for automatic opening of the modules such as display stands (D), display shelves, display-boxes, totems and other similar objects, obtained from cardboard cutting and creasing design.

For its application to the display stand (D), in the case of a cardboard display shelf produced by cutting and creasing design, as shown in the drawings attached, the hinge (14) is complemented by a continuous elastic strip in the shape of loop (15). Tabs (16) must be developed during the cutting and creasing design for the system operation, which must be positioned beveled, in an internal or posterior way, into the junction spots of the adjacent walls (P) of the display stand (D).

Also in the cutting and creasing design, each beveled tab (16) receives, cuts (17) performed in pairs, being an upper cut and a lower cut, distanced so as to form extensions (18) of hinge laying (14).

Thus composed and complemented by the elements forming the swinging system, for automatic flattening and opening the hinge (14), as shown for example by FIG. 2, is initially folded by the creases (2), (3), (4) and (5), so that it is laid in the extensions (18) of the beveled tab (16). The hinge (14) shall have sizes and shall be laid in number of units compatible with the display stand sizes (D) for the swinging system.

The hinges (14) are positioned by the backing sides (11) of their peripheral segments (9) and (10) which touch along the junction between the beveled tab (16) and adjacent walls (P). In such condition, the central segment (6) of the hinge (14) lays along the free edge of the beveled tab (16), surrounding it and positioning itself suitably in the extension (18).

Thus positioned, the hinge (14) exposes its indentation-guides (12) and (13) so that the elastic loop (15) is externally directed through them, guided in an upper and lower way along the height of intermediate segments (7) and (8), said elastic loop (15) being inserted then, strongly tensioned, into the cuts (17), so as to secure firmly the hinge (14) that surrounds or holds the extensions (18) of the beveled tab by means of the units employed, anchoring among the internal faces of the adjacent walls (P) of the display stand (D).

As shown by FIGS. 3 and 7, upon adjacent walls (P) closure, their internal faces touch and lead the peripheral segments (9) and (10), which folded by the creases (4) and (5) go flattening and pushing naturally the flattening of the central wall segments (7) and (8). With the flattening, the indentation-guides (12) and (13) are pushed away from the backing sides, causing strong pull from the elastic loop (15), anchored next to the cuts (17) of the beveled tab (16).

After flattening of the adjacent walls (P), the hinges (14) also flattened, embedded into the extensions (18) of the beveled tab (16) are with their segments (7), (8), (9) and (10) practically touching the internal faces of the adjacent walls (P) of the display stand (D) and strongly tensioned against them, pulled by the respective elastic loops (15) secured to the cuts (17).

With that, the display stand (D) may be kept flattened—provided that covered as a sandwich, with its front and posterior faces supported for example between two plates, or kept stretched inside an envelope. This way, parts such as display stands, totems or even more complex parts such as display shelves or display-boxes—provided that they have elements like boards, bottom, swinging sides since the cutting and creasing design, may be flattened and even folded in half, to be piled, transported and delivered in such condition to the user.

After being delivered to the consumer, while being used, when the envelope is opened, the free elastic loop, anchored between the indentations (12) and (13) and the cuts (17), immediately starts the return, pulling strongly the intermediate segments (7) and (8), folded by the creases (4) and (5). The peripheral segments (9) and (10), supported by their backing sides (11) at the junction point of the beveled tab and the adjacent walls (P) also swing, folding and causing contrary forces, thus opening automatically the hinge (14) in a clamping system, as shown by FIGS. 4 and 8, up to the central segment back (6) along the free edge of the beveled tab (16).

In such condition, the intermediate segments (7) and (8), naturally push the adjacent walls (P) of the display stand (D) and consequently open it automatically as shown by FIGS. 5 and 9.

The invention claimed is:

1. A display module having a rectangular cardboard plate, having spaced central creases and spaced side creases, each of said spaced side and said spaced central creases being vertical and extending from a upper edge to a lower edge of the cardboard plate to form five segments with a central segment of reduced width, adjacent to two intermediate segments and having two peripheral segments, the intermediate segments having a small indentation on an upper edge and a lower edge with the indentations on the lower edge aligned with the indentations on the upper edge, said indentations receiving an elastic strip for maintenance of the display module in a particular configuration.

2. The display module of claim 1 further including a tab located in an internal corner of the display module, said tab having a pair of vertically spaced slits.

3. The display module of claim 2, wherein a junction between the tab and adjacent walls of the display module mates with a rear side of the peripheral segments, contacting the internal corner so that the elastic strip may be inserted through each of said indentations and said slits to hold said cardboard plate in said corner.

4. The display module of claim 3 wherein the internal corner may be closed to a closed position where adjacent walls of the internal corner contact one another and flatten the intermediate and peripheral segments for contact of the respective segments with each other.

5. This display module claim 3 wherein the elastic strip upon movement to the closed position, pulls the intermediate segments and the peripheral segments apart and the adjacent walls apart to open the display module.

6. The display module of claim 4 wherein the intermediate segments push the adjacent walls of the display module to open it.

* * * * *